US006244461B1

(12) United States Patent
Roberts et al.

(10) Patent No.: US 6,244,461 B1
(45) Date of Patent: Jun. 12, 2001

(54) BEVERAGE HOLDER

(76) Inventors: Terrance Montgomery Roberts, 986 Pokai Way, Diamondhead, MS (US) 39525; William G. Fish, 13208 N. Cypress Dr., Gulfport, MS (US) 39503

( * ) Notice: Subject to any disclaimer, the term of this patent is extended or adjusted under 35 U.S.C. 154(b) by 0 days.

(21) Appl. No.: 09/465,045

(22) Filed: Dec. 16, 1999

Related U.S. Application Data

(60) Provisional application No. 60/112,432, filed on Dec. 16, 1998.

(51) Int. Cl.[7] ..... B65D 25/30
(52) U.S. Cl. ..... 220/740; 220/741
(58) Field of Search ..... 220/740, 741, 220/742, 743, 737, 903

(56) References Cited

U.S. PATENT DOCUMENTS

| | | | | |
|---|---|---|---|---|
| 2,896,812 | * | 7/1959 | Paprocki . | |
| 3,719,305 | * | 3/1973 | Pressnell | 220/740 |
| 4,735,333 | * | 4/1988 | Lay et al. | 220/739 |
| 4,823,975 | * | 4/1989 | Schwankl | 220/740 |
| 5,150,811 | * | 9/1992 | Kelston | 220/411 |
| 5,261,554 | * | 11/1993 | Forbes | 220/412 |

OTHER PUBLICATIONS

The Crystal Group; copies of internet brochure pages of various insulated can holders and can wraps from American Accents, Message Makers, SE Line, Custom Crest, KI, and the Zebra Line. Applicants first became aware of this material in Jan. 1999.

Sunrise Business Products–USA; copies of internet brochure pages of various plastic cups, mugs and insulated can holders. Applicants first became aware of this material in Jan. 1999.

* cited by examiner

*Primary Examiner*—Stephen Castellano
(74) *Attorney, Agent, or Firm*—Leydig, Voit & Mayers, Ltd.

(57) ABSTRACT

A beverage holder is disclosed. The beverage holder includes an insulative sleeve, a frame, and a lid. The beverage holder is constructed such that the frame can be snapped together around the sleeve, thereby retaining the sleeve. The frame can be configured such that indicia displayed on the retained sleeve are visible. The frame can be assembled to capture the lid such that the lid can rotate about a pair of posts. The lid can also readily receive a label displaying indicia.

30 Claims, 5 Drawing Sheets

BEVERAGE HOLDER

CROSS-REFERENCE TO RELATED PATENT APPLICATIONS

This patent application claims the benefit of priority to U.S. Provisional Application No. 60/112,432, filed Dec. 16, 1998, entitled "CAN STEIN," which is incorporated in its entirety herein by reference.

FIELD OF THE INVENTION

The present invention pertains generally to beverage holders. More particularly, the present invention relates to a beverage holder for maintaining a beverage at a desired temperature.

BACKGROUND OF THE INVENTION

Many beverages are packaged for sale in a can. The can containing the beverage is frequently stored in a refrigerator or a cooler, for example, to bring the beverage to a desired temperature for consuming the beverage. Upon removal of the can from the cooling source, the beverage in the can changes temperature over time. Further, during consumption of the beverage, the drinker's body temperature, transmitted through the hand holding the can, also changes the temperature of the beverage over time. To maintain the beverage in the can at the desired temperature for a longer period of time, a sleeve made from thermally-insulative material can be provided to store the can during transportation and/or consumption.

The popularity and long-lasting functionality of insulative sleeves have led many businesses to incorporate the insulative sleeve into an advertising strategy. For example, a company can give its customers insulative sleeves with the company's advertising message, such as its name, address, logo, product name(s), and/or slogan, placed on each holder. Also, individuals are often interested in applying a celebratory or novelty message, for example, to the beverage holder.

The insulative sleeve has some drawbacks, however. The insulative sleeve typically is a cylinder that encircles the can. Necessarily, the sleeve has a larger diameter than the can. A user may have difficulty in grasping the sleeve because the size of the sleeve is too large for his or her hand to grip comfortably. Often, the sleeve is made from a material that provides little frictional resistance when gripped, further increasing the difficulty of grasping the holder.

Further, the insulative sleeve is frequently used to transport and consume a beverage outside. Once a can is opened, insects, such as bees, and debris can enter the can and foul the beverage. Insects pose an acute problem because they are often drawn to the sugar and other substances found in soft drinks. In the case where a bee enters a can, the bee is likely to sting a person drinking from the can, potentially resulting in serious injury to the person. The prior art sleeve can not prevent insects and debris from entering the can.

BRIEF SUMMARY OF THE INVENTION

The invention provides a beverage holder and a method for assembling the holder. By way of example, the inventive beverage holder is useful for maintaining a beverage in a can at a desired temperature. In particular, the beverage holder of the present invention is provided with an insulative sleeve, a frame, and a lid.

The sleeve is configured to receive a beverage can. The sleeve has an outer wall that can display indicia.

The frame retains the sleeve and includes a first part, a second part, and a living hinge. The parts both include a plurality of resiliently flexible fingers and a hollow, cylindrical bearing. Each finger includes a locking lug with a ramped portion. Each finger is disposed to correspond with a finger on the other part such that a pair of corresponding fingers can retentively engage each other.

Advantageously, the frame can capture the sleeve and the lid as the frame is assembled. Once assembled, the frame includes a pair of retaining collars and a handle. The frame can include a support extending between the retaining collars. The frame can be configured such that the indicia displayed on the sleeve are visible.

The lid provides a barrier between a can inserted in the beverage holder and the outside environment. The lid is attached to the frame such that the lid is free to rotate about an axis defined by a pair of posts between open and closed positions. To facilitate the opening and closing of the lid, the lid can include a pair of ears, one located on each side of the neck of the lid and disposed adjacent the handle. The lid can also include a planar cover for receiving a label displaying indicia.

These and other objects and advantages, as well as additional inventive features, of the present invention will become apparent to one of ordinary skill in the art upon reading the detailed description, in conjunction with the accompanying drawings, provided herein.

DETAILED DESCRIPTION OF THE EMBODIMENTS

Figure 1:
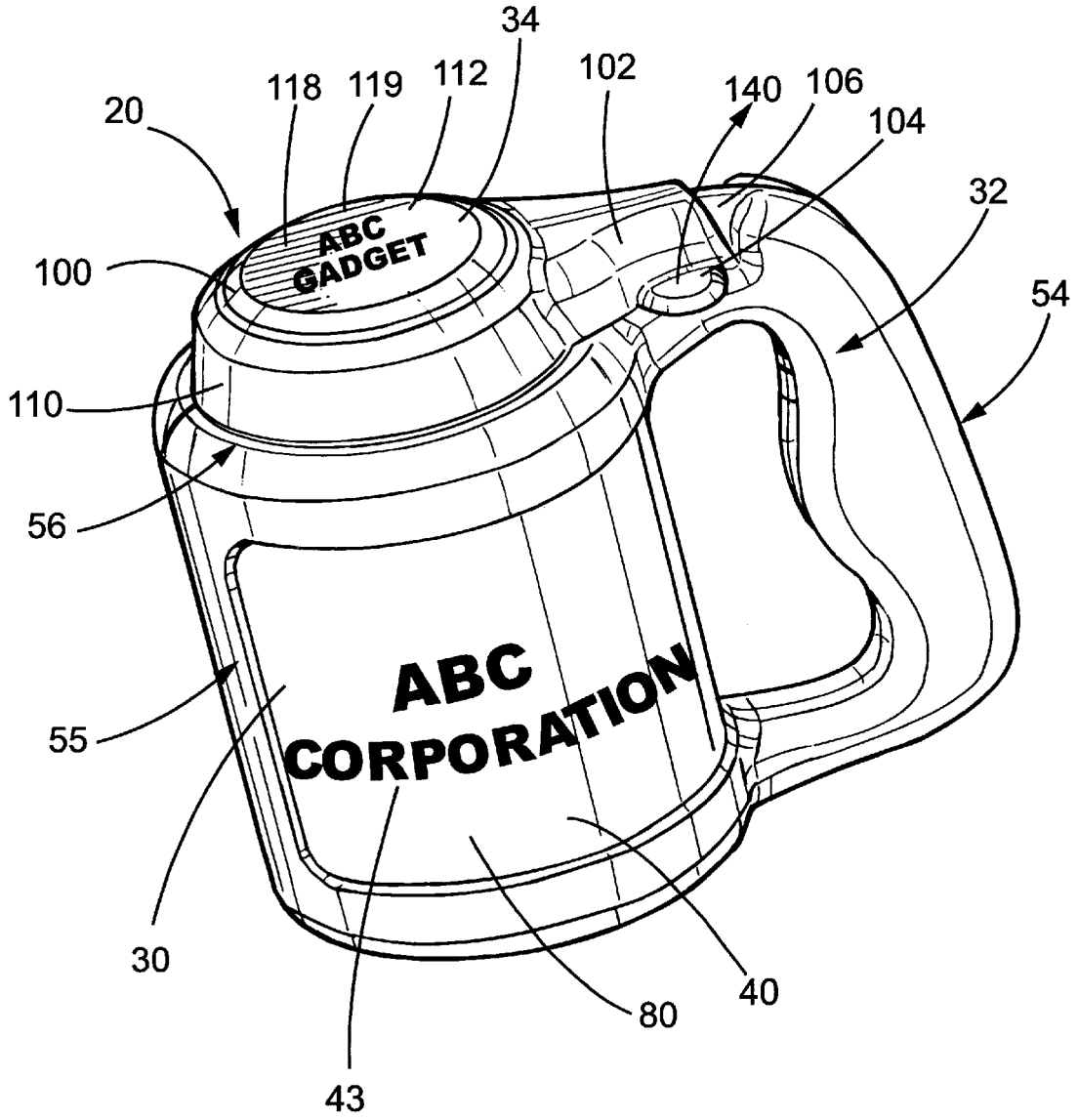
FIG. 1 is a perspective view of an illustrative beverage holder made in accordance with the present invention.

Referring now to the drawings, there is shown in FIG. 1 an illustrative beverage holder 20 for storing a beverage can. In particular, the beverage holder 20 of the present invention includes an insulative sleeve 30, a frame 32, and a lid 34. The sleeve 30 is retained by the frame 32. The lid 34 is attached to the frame 32 such that the lid 34 is free to rotate.

The sleeve 30 thermally insulates a can (not shown) inserted in the sleeve and acts to maintain the beverage in the inserted can at a desired temperature. More specifically, the sleeve 30 has a hollow cylindrical configuration sized to receive conventionally-sized beverage cans. The sleeve 30 can be any suitable thermally-insulative material, such as, for example, open-cell foam rubber, polystyrene foam. The material of the sleeve 30 can be rigid or pliable.

Figure 3:
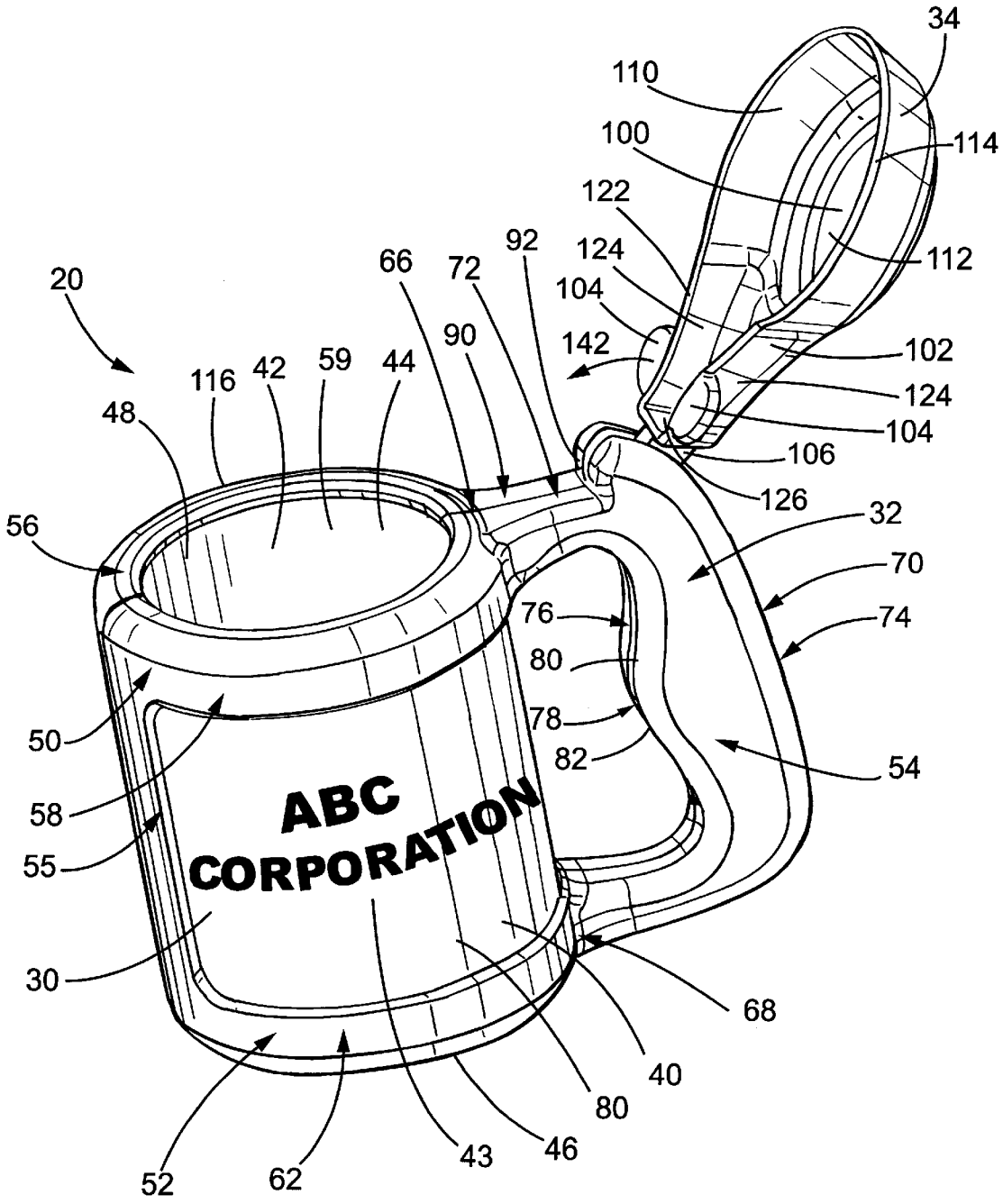
FIG. 3 is a perspective view of the beverage holder with the lid in the open position.

Referring to FIG. 3, the sleeve 30 has an outer wall 40 and an inner wall 42 which define the thickness of the sleeve 30. The outer wall 40 can be used to display any type of indicia 43. The indicia 43 can be applied to the outer wall 40 by any known process, such as, for example, silk screening. In the illustrated embodiment, the indicia 43 are letters reading "ABC Corporation"; however, it will be appreciated that the indicia 43 can be varied. For example, the indicia 43 can display any desired textual message and/or graphical symbol.

The size of the sleeve 30 can be varied and can be sized to conform to standard dimensions commonly used in the art. For example, the diameter of the inner wall 42 can be sized such that the inner wall 42 is in contacting relation with a can that is inserted in the sleeve 30. It will be appreciated that in the case where the inner wall 42 has a diameter that is larger than the diameter of the can, the sleeve 30 still remains operative. The outer wall 40, in turn, can be sized such that the wall 40 is in contacting relation with the frame 32.

The sleeve 30 includes an upper and a lower end 44, 46. The upper end 44 includes an upper aperture 48 sized for receiving a can therethrough. In this case, the lower end 46 has a lower aperture (not shown) that extends through the inner wall 42. In other embodiments, the lower end 46 can include a circular surface that covers the lower end 46 or an annular surface that projects inward from the inner wall 42, for example. In the embodiments wherein the lower end 46 has a surface that projects inward from the inner wall 42 such that at least a portion of the surface is disposed in confronting relation with an inserted can, the lower end 46 acts to retain and support the can.

In the illustrated embodiment, the sleeve 30 is sized such that an end of the can protrudes from the sleeve 30 when the can is fully inserted in the sleeve 30. In use, the can is inserted into the beverage holder 20 such that the upper end of the can protrudes from the sleeve 30. The distance between the upper end 44 of the sleeve 30 and the upper end of the inserted can may be sized such that a user's lower lip can be readily placed on the can.

The frame 32 retains the sleeve 30 and captures the lid 34 such that the lid 34 can rotate about a predetermined axis as described below but is otherwise fixed. The frame 32 can be made from any suitable material, such as, for example, polypropylene or other plastic materials. The frame 32 includes a first retaining collar 50, a second retaining collar 52, a handle 54,and a support 55.

As shown in FIG. 3, the first and second retaining collars 50, 52 are disposed around the upper and lower ends 44, 46, respectively, of the sleeve 30 such that the sleeve 30 is disposed between the first and second retaining collars 50, 52. The first retaining collar 50 includes a rim 56 and a first flange 58. The rim 56 is circular and defines a collar aperture 59 that is sized to accept a can therethrough. Moreover, the rim 56 is contoured and presents a convex surface to the user. The first flange 58 is also circular and is sized to accommodate the diameter of the outer wall 40 of the sleeve 30. The first flange 58 can be sized such that it is in contacting relation with the outer wall 40 of the sleeve 30.

Figure 2:
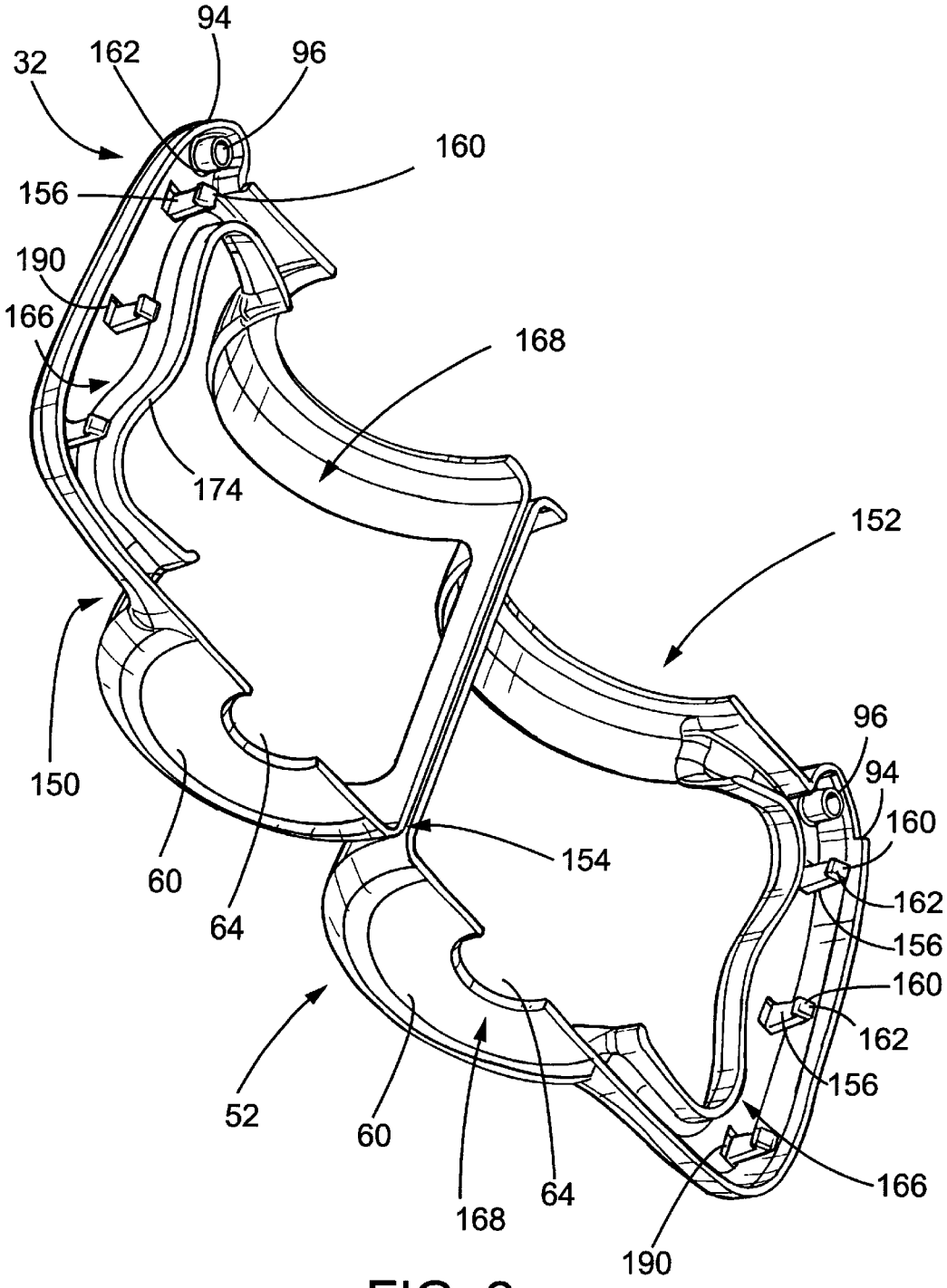
FIG. 2 is a perspective view of the frame of the beverage holder in an unassembled condition.

The second retaining collar 52 includes a base 60 (FIG. 2) and a second flange 62. Referring to FIG. 2, the base 60, when assembled, comprises an annular disc. When the frame 32 is assembled, the lower end 46 of the sleeve 30 (FIG. 3) can be placed in contacting relation with the base 60. Thus, when the beverage holder is in use, the base 60 can act to support can. Referring to FIG. 3, the first and second flanges 58, 62 have similar configurations.

It will be appreciated that the height of the frame 32 can be varied and the frame 32 can still act to retain the sleeve 30. It is preferred, however, that the height of the frame 32 conform to the height of the sleeve 30 such that when the sleeve is installed in the frame 32, the flanges 58, 62 are in interfering relation with the sleeve 30.

The handle 54 provides a convenient structure for holding the beverage holder 20. The handle 54 is attached at first and second ends 66, 68 thereof to the first and second retaining collars 50, 52, respectively. To facilitate handling of the beverage holder, the handle 54 further includes a gripping portion 70. The gripping portion 70 includes a planar surface 74 and a contoured surface 76 disposed on opposite sides of the gripping portion 70. The planar surface 74 is configured to accept the palm of a hand. The contoured surface 76, in turn, is configured to facilitate gripping by providing a protuberance 78 with sides 80, 82. As will be appreciated, the fingers of a user can be placed on the contoured surface 76 such that the protuberance 78 is interposed between at least two fingers.

To provide rigidity to the frame 32, the support 55 is provided. The support 55 is attached to the first and second retaining collars 50, 52 and extends therebetween. In the illustrated embodiment the support 55 is disposed opposite the handle 54. Together with the handle 54, the support 55 maintains the first and second retaining collars 50, 52 in predetermined, spaced relation. The support 55 and the first and second retaining collars 50, 52 define an opening 80. The indicia 43 of the sleeve 30 are visible through the opening 80.

Figure 5:
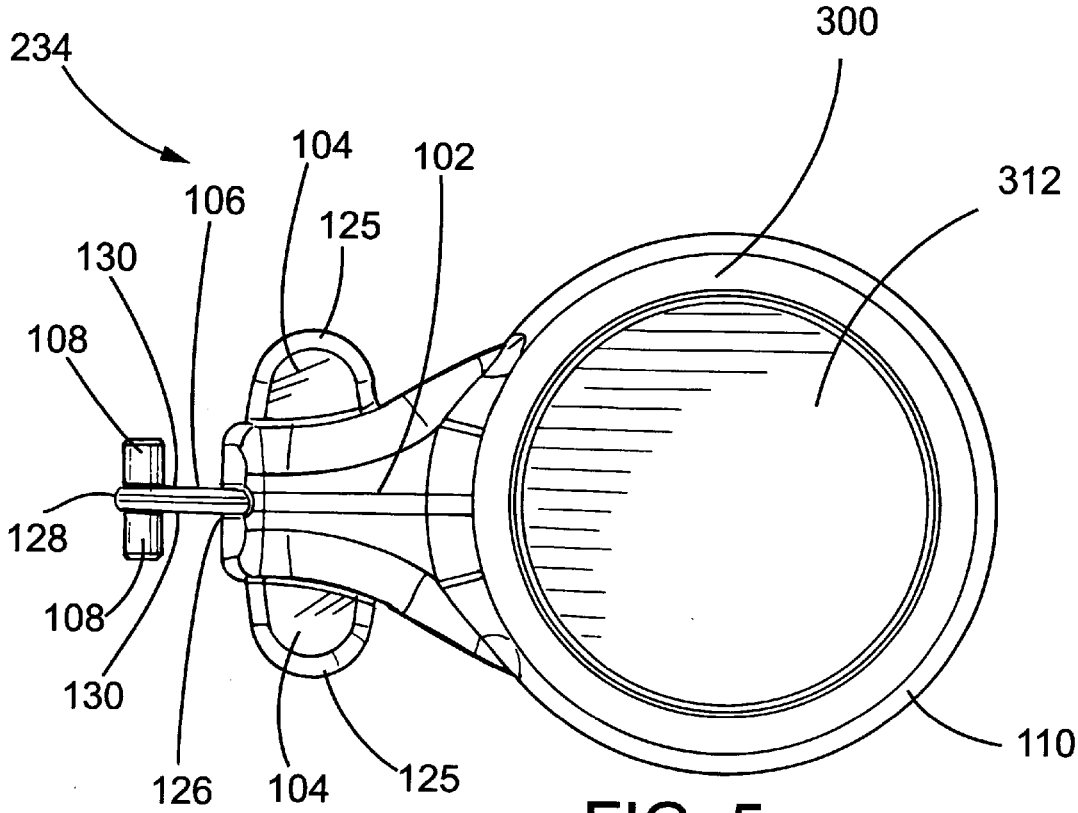
FIG. 5 is a top plan view of another embodiment of the lid.

Referring to FIG. 1, the lid 34 provides a barrier between a can inserted in the beverage holder 20 and the outside environment. The lid 34 is attached to the handle 54 such that the lid 34 can rotate between a closed position, as shown in FIG. 1, and an opened position, as shown in FIG. 3. The lid 34 can be made from any suitable material, such as, for example, polypropylene or other plastic materials. Referring to FIG.3, the lid 34 includes a cover portion 100, a neck portion 102, a pair of ears 104, an arm 106, and a pair of posts 108 (FIG. 5).

To facilitate operation of the lid, the handle 34 further includes a lid portion 72 having a landing surface 90, a slot 92, a pair of stops 94 (FIG. 2), and a pair of cylindrical bearings 96 (FIG. 2). Referring to FIGS. 2 and 3, the lid 34 can move between the landing surface 90 and the stops 94. The landing surface 90 is, in this case, flush with the rim 56 and acts to provide support for the lid 34 when the lid 34 is in the closed position as shown in FIG. 1.

The slot 92 is sized to accommodate the arm 106 of the lid 34 and helps guide the lid 34 into the closed position. The stops 94 (FIG. 2) can act to provide support for the lid 34 when the lid 34 is in the opened position, as shown in FIG. 3. Referring to FIG. 2, the cylindrical bearings 96 are hollow and can capture the posts 108 of the lid 34 (FIG. 5) such that the lid 34 is free to rotate about a longitudinal axis of the bearings 96.

Referring to FIGS. 1 and 3, to move the lid 34 between the closed position and the opened position, the user can use a thumb or finger to contact one of the ears 104 and to move the ear 104 in an opening direction 140 (FIG. 1) or a closing direction 142 (FIG. 3). Accordingly, the ears 104 facilitate the movement of the lid 34 while the user holds the beverage holder 20. Of course, it will be appreciated that the lid 34 can be moved by grasping other parts of the lid, as well.

The ears 104 each have a rounded free end and are disposed adjacent the handle 54 and project from opposite sides 124 of the neck portion 102 as shown in FIG. 5. Providing an ear 104 on each side 124 of the neck portion 102 allows the user to open or close the lid using either of the ears 104 and either hand. In other words, the user can grasp the handle 54 and operate one of the ears 104 with either hand.

Referring to FIG.1, the cover portion 100 includes a depending cover flange 110 and a raised cover 112. Referring to FIG. 3, the cover portion 100 can be sized such that the depending flange 110 has a diameter that is equal to or greater than the diameter of the collar aperture 59 and equal to or less than the diameter of the first flange 58 of the frame 32, as shown in FIG. 3. Thus, when the lid 34 is in the closed position, the depending flange 110 contacts the rim 56 of the first retaining collar 50 and the cover portion 100 defines a barrier between the outside environment and the can inserted in the beverage holder 20.

To provide a positive connection between the lid 34 and the rim 56 of the first retaining collar 50 when the lid 34 of the illustrated beverage holder is in the closed position, complementary chamfered surfaces 114, 116 on the cover portion 100 and the rim 56 are placed in mating contact. It will be appreciated that the complementary chamfered surfaces 114, 116 need not be in mating contact over the entire area of the surfaces to provide such a positive connection.

To provide additional surface area for the application of indicia, the illustrative raised cover 112 of the lid 34 can be sized to receive a label 118 bearing indicia 119. In the illustrated embodiment, the label 118 is a two-inch diameter circle. The label 118 can be affixed to the cover 112 by any known method, such as, for example, by an adhesive backing. In the illustrated embodiment, the indicia 119 are letters reading "ABC Gadget." Of course, it will be appreciated that the indicia 119 can be varied to display any desired textual message and/or graphical symbol.

The neck portion 102 tapers from the cover portion 100 narrowing to the arm 106. The neck portion 102 and the cover portion 100 are integrally attached. The neck portion 102 includes an end surface 122 which in the illustrated embodiment is configured to come in contacting relation with the landing surface 90 when the lid 34 is in the closed position. It will be appreciated however, that the lid 34 need not contact the landing surface 90 for the lid 34 to be operative.

Figure 6:
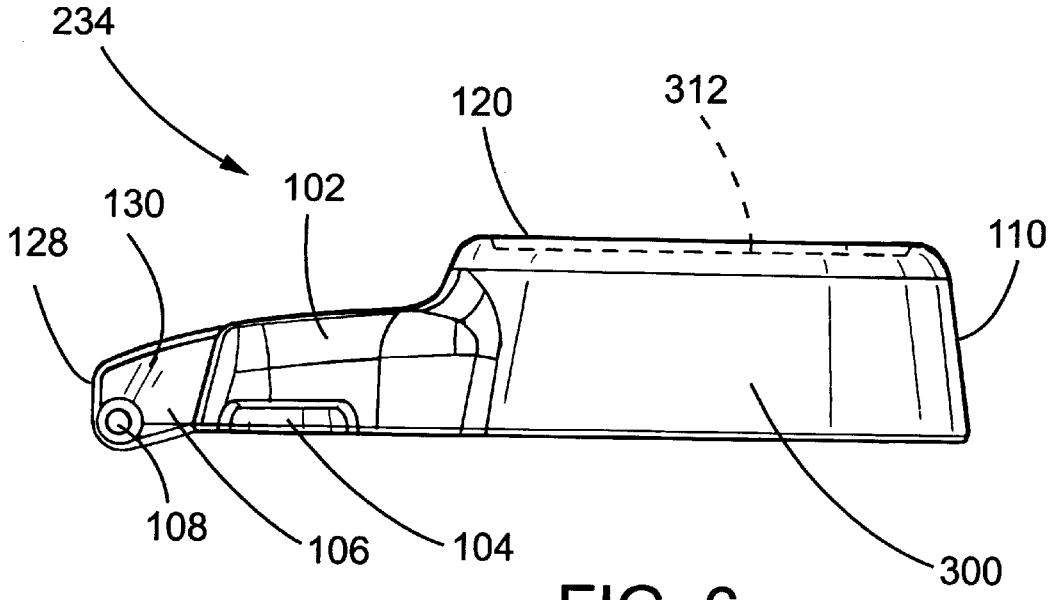
FIG. 6 is an elevational side view of the lid of FIG. 5.

To facilitate movement of the lid between the open and closed positions, the lid includes the arm 106 which projects from an end 126 of the neck portion 102 and is received within, and movable with respect to, the slot 92 as shown in FIG. 3. Referring to FIGS. 5 and 6, the posts 108 project from opposing sides 130 of the arm adjacent a free end 128 thereof. The posts 108 are cylindrical shafts disposed such that the longitudinal axes of the posts 108 are aligned with each other. The posts 108 are received within the respective cylindrical bearings 96 and are free to rotate within the bearings 96 about their longitudinal axes (FIGS. 2 and 5).

FIGS. 5 and 6 depict another embodiment of a lid 234 for the beverage holder. The lid 234 includes a cover portion 300, a neck portion 102, a pair of ears 104, an arm 106, and a pair of posts 108. The cover portion 300 includes a flange 110 and a circular recessed cover 312 sized to accept the label 118 (FIG. 1). To protect, and to help prevent unintended removal of, the label 118, the recessed cover 312 is offset from an upper edge 120 a depth that is equivalent to or greater than the thickness of the label 118 as shown in FIG. 6. The label 118 can be inserted into the recess 314 and affixed to the recessed cover 312.

The lid 234 is similar to the lid 34 shown in FIGS. 1 and 3 except for the cover portion 300 with similar structure being indicated by the same reference numeral. Thus, the discussion regarding the neck portion 102, the ears 104, the arm 106, and the posts 108, is applicable both the lid 34 shown in FIGS. 1 and 3 and the lid 234 shown in FIGS. 5 and 6.

To use the beverage holder 20, the user can place the lid 34 in the opened position and insert a beverage can through the collar aperture 59 and the aperture 48 of the sleeve 30 and into the sleeve 30. Continued insertion of the can seats the can upon the base 60 of the second retaining collar 52. When the user desires, regardless of whether the beverage can is open, the lid 34 can be moved to the closed position in order to protect the beverage can from the environment.

To remove the beverage can from the beverage holder, the user can pull the beverage can out from the sleeve 30 by gripping the upper end of the can. Referring to FIG. 2, to facilitate removal of the beverage can from the holder 20, an aperture 64 is provided in the base 60 of the frame 32. The user can insert a finger, such as the thumb or index finder, through the aperture 64 and push the can at least partially out of the sleeve 30. With the can partially removed from the sleeve 30, the user can readily grip the beverage can with the other hand to complete removal.

In accordance with an important feature of the invention, the frame 32 can capture the sleeve 30 and the lid 34 as the frame 32 is assembled. Referring to FIG. 2, the illustrative frame 32 includes a first part 150 and a second part 152 which are connected, in this case, by a living hinge 154. The first and second parts 150, 152 of the frame 132 each include a corresponding plurality of resiliently flexible fingers 156 and one of the cylindrical bearings 96. The first and second parts 150, 152 are mirror images of each other about the living hinge 154 with the exception of the fingers 156. The fingers 156 are configured such that the fingers 156 of the first part 150 retentively engage the fingers 156 of the second part 152. To facilitate this engagement, each finger 156 includes a base 158 and a locking lug 160 with a ramped portion 162.

To facilitate assembly of the first and second parts 150, 152 while at the same time retaining the sleeve 30 and capturing the lid 34, the first and second parts 150, 152 each include a handle portion 166 and a retaining portion 168. To assemble the beverage holder, the sleeve 30 is placed in the retaining portion 168 of either of the parts 150, 152. In addition, one of the posts 108 of the lid 34 is inserted into one of the cylindrical bearings 96, preferably of the same part 150 or 152 that holds the sleeve 30. The lid 34 is oriented such that when the frame 32 is assembled, the arm 106 is in the slot 92 and the cover portion 100 can be placed in contacting relation with the rim 56 of the first retaining collar 50. To close the frame 32, the first and second parts 150, 152 are rotated relative to each other about the living hinge 154. The ramped portions 162 of each pair of corresponding fingers 156 contact each other and deflect about the bases 158. After continued movement of the parts 150, 152, the pairs of corresponding fingers 156 "snap" together. The locking lugs 160 of each pair of corresponding fingers 156 engage each other, securing the parts 150, 152 together. As the first and second parts 150, 152 are closed, the other post 108 is inserted into the other cylindrical bearing 96.

To disassemble the frame 32, a pry, such as, for example, a screwdriver, can be inserted into a rectangular bore 90, provided adjacent each finger 156, and manipulated to deflect the pair of corresponding fingers 156 associated with the bore 90. By pulling on the parts 150, 152 in opposite directions, the locking lugs 160 of the pair of corresponding fingers can be disengaged. The unlocking step can be repeated until each pair of corresponding fingers 156 is no longer retentively engaged.

Figure 4:
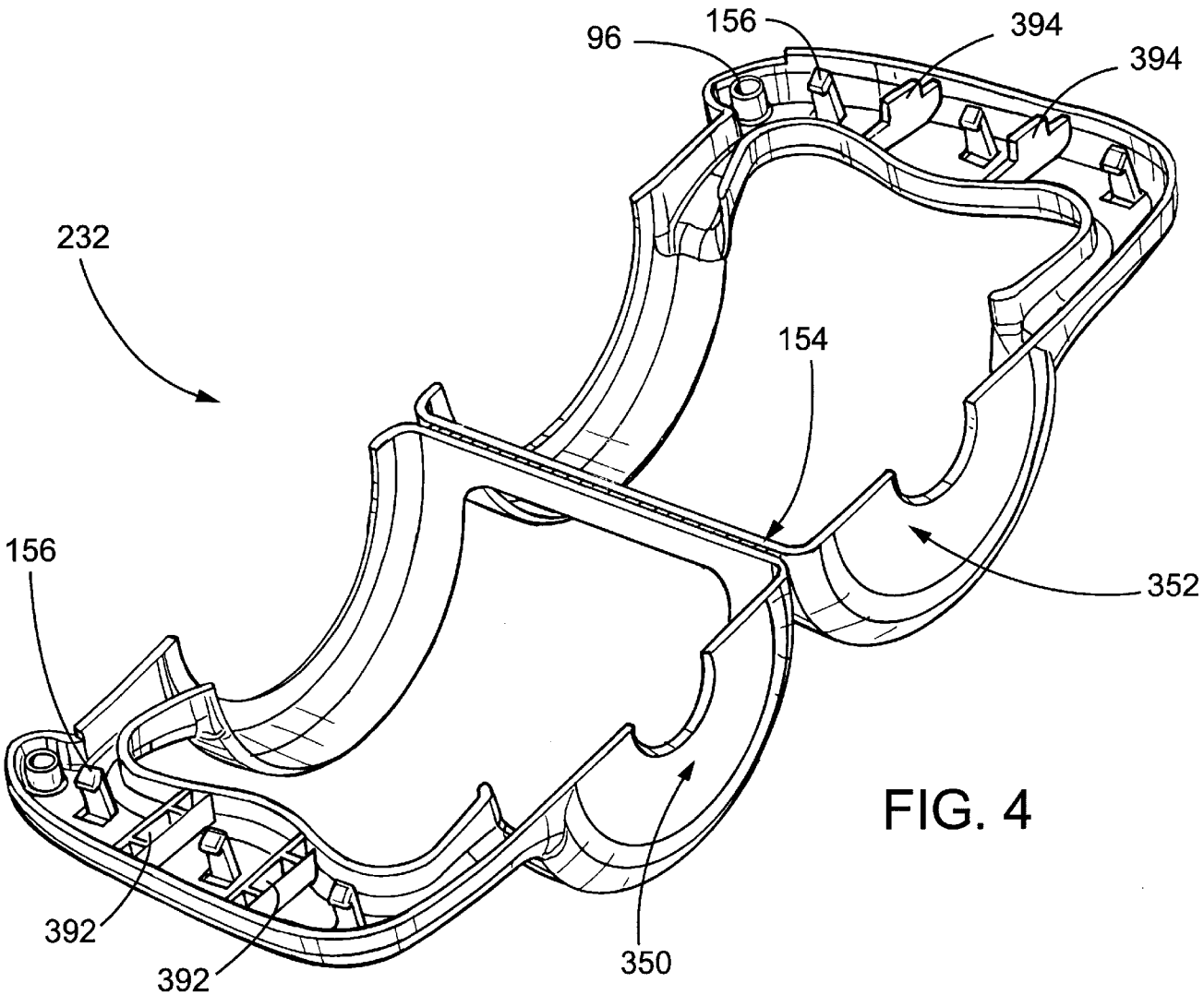
FIG. 4 is a perspective view of another embodiment of the frame of the beverage holder in an unassembled condition.

FIG. 4 depicts another embodiment of a frame 232 constructed in accordance with the present invention. The frame includes a first part 350, a second part 352, and a living hinge 154. The first part 350 includes a pair of slots 392 running through the first part 350. To facilitate the alignment of the mating surfaces when the parts 350, 352 are attached, the second part 352 includes a pair of alignment tabs 394. The tabs 394 are configured to align with, and fit within, the slots 392 when the parts 350, 352 are attached. During the attachment of the parts 350, 352 to each other, the alignment tabs 394 engage the slots 392 and act to locate the parts 350, 352 with respect to each other such that the parts 350, 352 align. To further align the mating surfaces after the parts 350, 352 are attached, the tabs 394 can be adjusted by using a pry, for example. The pry can be inserted into the slot 392 to engage the tab 394. The pry can then be used as a lever between the slot 392 and the tab 394 to move the parts 350, 352 with respect to each other such that the mating surfaces are aligned. The frame 232 is similar to the frame 32 in all other respects.

In summary, the beverage holder is constructed such that the frame can be snapped together around an insulative sleeve, thereby retaining the sleeve. The frame is configured such that indicia displayed on the retained sleeve can be viewed. The frame can be assembled to capture a lid such that the lid can rotate about a pair of posts. The insulating sleeve can readily receive indicia. The lid can also readily receive a label displaying indicia.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. A holder for receiving a can and a sleeve, the sleeve having an aperture for receiving a can therethrough, the holder comprising:

a frame having a first retaining collar, a second retaining collar, and a handle, the first retaining collar having an aperture which is sized for receiving a can therethrough, the second retaining collar having a base which is configured to support the can, the first and second retaining collars being configured to retain the sleeve, the handle having a first end and a second end, the first end being attached to the first retaining collar and the second end being attached to the second retaining collar, and a lid sized to encompass the aperture through the first retaining collar, the lid being attached to the handle so as to be movable between an opened position and a closed position, and the lid having a landing surface, a slot, a stop, a first bearing and a second bearing.

2. The holder as described in claim 1 wherein the first retaining collar further comprises a rim and a flange.

3. The holder as described in claim 1 wherein the second retaining collar further comprises a flange.

4. The holder as described in claim 1 wherein the base of the second retaining collar further comprises an aperture.

5. The holder as described in claim 4 wherein the aperture is concentric with the base.

6. The holder as described in claim 1 wherein the frame has a first height and the sleeve has a second height, the first height and the second height conforming to each other.

7. The holder as described in claim 1 wherein the handle further comprises a gripping portion and a lid portion.

8. The holder as described in claim 7 wherein the gripping portion further comprises a protuberance.

9. The holder as described in claim 1 wherein the lid further comprises a first ear.

10. The holder as described in claim 9 wherein the lid further comprises a first side, a second side, and a second ear, the first ear disposed on the first side, the second ear disposed on the second side, the first side and the second side opposed to each other.

11. The holder as described in claim 1 wherein the lid further comprises a first post, a second post, and an arm, the first post and the second post projecting from opposite sides of the arm, the first post inserted in the first bearing, the second post inserted in the second bearing, the arm movable through the slot, the lid movable between the landing surface and the stop.

12. The holder as described in claim 1 wherein the lid further comprises a flange, a rim, and a cover, the flange sized such that the flange encompasses the aperture of the first retaining collar.

13. The holder as described in claim 12 wherein the cover is offset from the rim.

14. The holder as described in claim 13 wherein the cover is recessed in relation to the rim of the lid toward the base of the second retaining collar.

15. The holder as described in claim 13 wherein the cover is raised in relation to the rim of the lid away from the base of the second retaining collar.

16. The holder as described in claim 12 wherein the cover is configured to receive a label.

17. The holder as described in claim 16 wherein the label has a two-inch diameter.

18. The holder as described in claim 14 wherein the cover is configured to receive a label.

19. The holder as described in claim 18 wherein the label has a two-inch diameter.

20. The holder as described in claim 1 wherein the first retaining collar further comprises a rim having a first chamfered surface and the lid further comprises a second chamfered surface, the first and second chamfered surfaces matingly conforming to each other when the lid is in a closed position.

21. The holder as described in claim 1 wherein the frame further comprises a support attached to the first and the second retaining collars.

22. A holder for storing a can and a sleeve, the sleeve having an aperture for receiving the can therethrough, comprising:

a frame having a first part, a second part, and a living hinge, the living hinge connected to the first part and the second part, the first part and the second part being rotatable with respect to each other about the living hinge, the first part and the second part being assembled to each other to define a first retaining collar, a second retaining collar, and a handle, the first retaining collar having an aperture, the second retaining collar having a base which is configured to support the can, the first and second retaining collars being configured to retain the sleeve which has an aperture for receiving the can therethrough, the handle having a first end and a second end, the first end being attached to the first retaining collar and the second end being attached to the second retaining collar, and a lid sized to encompass the aperture of the first retaining collar and attached to the handle, the lid being movable between an opened position and a closed position.

23. The holder as described in claim 22 wherein the first part further comprises a first retaining portion and a first handle portion, and the second part further comprises a second retaining portion and a second handle portion.

24. The holder as described in claim 22 wherein the first part further comprises a plurality of fingers and the second part further comprises a corresponding plurality of fingers, each finger of the first part configured to retentively engage a corresponding finger of the second part, thereby assembling the first part and the second part to each other.

25. The holder as described in claim 24 wherein the frame further comprises a living hinge, the living hinge connected to the first part and the second part, the first part and the second part being rotatable with respect to each other about the living hinge.

26. The holder as described in claim 24 wherein the first part further comprises a slot and the second part further comprises a tab, the frame and the slot being configured to align, the tab being configured to fit within the slot.

27. A holder for storing a can and a sleeve, the sleeve having an aperture for receiving the can therethrough, comprising:

a frame having a first part and a second part, the first part including a plurality of fingers and the second part including a corresponding plurality of fingers, each finger of the first part configured to retentively engage a corresponding finger of the second part, thereby assembling the first part and the second part to each other, the first part and the second part being assembled to each other to define a first retaining collar, a second retaining collar, and a handle, the first retaining collar having an aperture, the second retaining collar having a base which is configured to support the can, the first and second retaining collars being configured to retain the sleeve which has an aperture for receiving the can therethrough, the handle having a first end and a second end, the first end being attached to the first retaining collar and the second end being attached to the second retaining collar, and a lid sized to encompass the aperture of the first retaining collar and attached to the handle, the lid being movable between an opened position and a closed position.

28. The holder as described in claim 27 wherein the first part further comprises a first retaining portion and a first handle portion, and the second part further comprises a second retaining portion and a second handle portion.

29. The holder as described in claim 27 wherein the frame further comprises a living hinge, the living hinge connected to the first part and the second part, the first part and the second part being rotatable with respect to each other about the living hinge.

30. The holder as described in claim 27 wherein the first part further comprises a slot and the second part further comprises a tab, the frame and the slot being configured to align, the tab being configured to fit within the slot.

* * * * *